US009903249B2

(12) United States Patent
Alber et al.

(10) Patent No.: US 9,903,249 B2
(45) Date of Patent: Feb. 27, 2018

(54) HEAT EXCHANGER ARRANGEMENT, ESPECIALLY FOR A VEHICLE HEATER

(71) Applicant: Eberspächer Climate Control Systems GmbH & Co. KG, Esslingen (DE)

(72) Inventors: Andreas Alber, Stuttgart (DE); Michael Haefner, Stuttgart (DE); Andreas Collmer, Aichwald (DE)

(73) Assignee: Eberspächer Climate Control Systems GmbH & Co. KG, Esslingen (DE)

( * ) Notice: Subject to any disclaimer, the term of this patent is extended or adjusted under 35 U.S.C. 154(b) by 267 days.

(21) Appl. No.: 14/809,599

(22) Filed: Jul. 27, 2015

(65) Prior Publication Data

US 2016/0023535 A1 Jan. 28, 2016

(30) Foreign Application Priority Data

Jul. 28, 2014 (DE) ..... 10 2014 214 768

(51) Int. Cl.
*F02M 31/08* (2006.01)
*F01N 5/02* (2006.01)
(Continued)

(52) U.S. Cl.
CPC ..... *F01N 5/02* (2013.01); *F24H 1/263* (2013.01); *F24H 9/148* (2013.01); *F28D 1/06* (2013.01); *F28F 7/02* (2013.01); *F28D 7/12* (2013.01); *F28D 21/0003* (2013.01); *F28F 2230/00* (2013.01); *F28F 2255/14* (2013.01)

(58) Field of Classification Search
CPC . F01N 5/02; F24H 1/263; F24H 9/148; F28D 1/06; F28D 7/12; F28D 21/0003; F28F 7/02; F28F 2230/00; F28F 2255/14
(Continued)

(56) References Cited

U.S. PATENT DOCUMENTS 5,022,379 A * 6/1991 Wilson, Jr. ..... F28D 7/103 122/18.3
5,205,250 A * 4/1993 Easterly ..... F02N 19/04 123/142.5 R
(Continued)

FOREIGN PATENT DOCUMENTS

CN 85104503 A * 12/1986
CN 85104503 B 12/1986
(Continued)

OTHER PUBLICATIONS

European Search Report dated Oct. 8, 2015.

*Primary Examiner* — Justin Jonaitis
(74) *Attorney, Agent, or Firm* — McGlew and Tuttle, P.C.

(57) ABSTRACT

A vehicle heater heat exchanger arrangement (10) includes: a pot-like heat exchanger housing (12) with a first bottom wall (18) in a first axial end area (16) and with a first circumferential wall (20) adjoining the first bottom wall and enclosing a longitudinal axis (L); and a pot-like outer heat exchanger housing (14) with a second bottom wall (22) in the first axial end area and with a second circumferential wall (24) adjoining the second bottom wall and enclosing the longitudinal axis. The inner heat exchanger housing and the outer heat exchanger housing are connected to one another in a second axial end area (26) and a fluid flow space (34) is formed between the inner heat exchanger housing and the outer heat exchanger housing. The second axial end area has an outwardly open recess (60) defined by the inner heat exchanger housing or/and by the outer heat exchanger housing.

20 Claims, 4 Drawing Sheets

(51) Int. Cl.

| | |
|---|---|
| ***F24H 9/14*** | (2006.01) |
| ***F24H 1/26*** | (2006.01) |
| ***F28F 7/02*** | (2006.01) |
| ***F28D 1/06*** | (2006.01) |
| *F28D 7/12* | (2006.01) |
| *F28D 21/00* | (2006.01) |

(58) Field of Classification Search
USPC ..... 165/52, 136
See application file for complete search history.

(56) References Cited

U.S. PATENT DOCUMENTS

| | | | | |
|---|---|---|---|---|
| 6,089,465 | A | 7/2000 | Habijanec et al. | |
| 6,872,073 | B2 * | 3/2005 | Collmer | F23D 11/404 431/261 |
| 2004/0200606 | A1 | 10/2004 | Higashiyama | |
| 2015/0174988 | A1 * | 6/2015 | Collmer | F24H 1/009 165/154 |

FOREIGN PATENT DOCUMENTS

| | | | |
|---|---|---|---|
| CN | 1545608 | A | 11/2004 |
| DE | 34 16 878 | A1 | 11/1985 |
| DE | 41 00 523 | C2 | 1/1992 |
| DE | 197 49 821 | C1 | 3/1999 |
| DE | 197 49 809 | A1 | 5/1999 |
| DE | 198 00 241 | C1 | 6/1999 |
| DE | 101 43 458 | A1 | 3/2003 |
| DE | 10 2006 012 925 | A1 | 9/2007 |
| DE | 10 2006 031606 | A1 | 1/2008 |
| EP | 0627065 | A1 | 12/1994 |
| WO | 9317290 | A1 | 9/1993 |

* cited by examiner

HEAT EXCHANGER ARRANGEMENT, ESPECIALLY FOR A VEHICLE HEATER

CROSS REFERENCE TO RELATED APPLICATIONS

This application claims the benefit of priority under 35 U.S.C. § 119 of German Patent Application DE 10 2014 214 768.9 filed Jul. 28, 2014, the entire contents of which are incorporated herein by reference.

FIELD OF THE INVENTION

The present invention pertains to a heat exchanger arrangement, especially for a vehicle heater, comprising a pot-like (pot-shaped) inner heat exchanger housing with a first bottom wall in a first axial end area of the heat exchanger arrangement and with a first circumferential wall adjoining the first bottom wall and enclosing a longitudinal axis, a pot-like outer heat exchanger housing with a second bottom wall in the first axial end area of the heat exchanger arrangement and with a second circumferential wall adjoining the second bottom wall and enclosing the longitudinal axis, wherein the inner heat exchanger housing and the outer heat exchanger housing are connected to one another in a second axial end area, as well as a fluid flow space formed between the inner heat exchanger housing and the outer heat exchanger housing.

BACKGROUND OF THE INVENTION

A heat exchanger arrangement for a fuel-operated vehicle heater, in which the inner one of the two heat exchanger housings has a double-walled design in an axial end area of the heat exchanger arrangement, which end area is located at a distance from the bottom walls of the two pot-like (pot-shaped) heat exchanger housings inserted one into the other, is known from DE 198 00 241 C1. The inner heat exchanger housing defines in this area the fluid flow space formed between the two heat exchanger housings with a front wall, which is formed thereon [the heat exchanger housing] and extends circumferentially in a ring-shaped manner about a longitudinal axis of the housing, and is connected with its outer circumferential wall, which likewise extends circumferentially in a ring-shaped manner, to the circumferential wall of the outer heat exchanger housing. A waste gas outlet opening, formed in a waste gas outlet connecting piece, is provided in the axial end area of the heat exchanger arrangement, which said end area is located at a distance from the bottom walls. This connecting piece breaks through the fluid flow space with the waste gas outlet opening formed therein and is open, on the one hand, to a waste gas flow space enclosed by the inner heat exchanger housing. The fluid inlet opening leading to the fluid flow space and likewise the fluid outlet opening leading away from the fluid flow space are formed in the axial end area of the heat exchanger arrangement, which end area is located close to the bottom walls, in the outer one of the two heat exchanger housings in respective connection branches.

SUMMARY OF THE INVENTION

An object of the present invention is to provide a heat exchanger arrangement, especially for a vehicle heater, in which heat losses are reduced.

This object is accomplished according to the present invention by a heat exchanger arrangement, especially for a vehicle heater, comprising a pot-like (pot-shaped) inner heat exchanger housing with a first bottom wall in a first axial end area of the heat exchanger arrangement and with a first circumferential wall adjoining the first bottom wall and enclosing a longitudinal axis; a pot-like outer heat exchanger housing with a second bottom wall in the first axial end area of the heat exchanger arrangement and with a second circumferential wall adjoining the second bottom wall and enclosing the longitudinal axis, wherein the inner heat exchanger housing and the outer heat exchanger housing are connected to one another in a second axial end area of the heat exchanger arrangement; as well as a fluid flow space formed between the inner heat exchanger housing and the outer heat exchanger housing. Further, provisions are made for providing at least one outwardly open recess in the material of which the inner heat exchanger housing is made or/and in the material of which the outer heat exchanger housing is made at least in the second axial end area of the heat exchanger arrangement.

Further, provisions are made for providing at least one an outwardly open recess in the material of which the inner heat exchanger housing is made or/and in the material of which the outer heat exchanger material is made at least in the second axial end area of the heat exchanger arrangement.

By providing at least one recess in the material of which the inner heat exchanger housing is made or/and in the material of which the outer heat exchanger material is made, a cavity is created, which is filled, in general, with air, but is basically closed towards the fluid flow space. Since the two heat exchanger housings, but at least the inner heat exchanger housing, which is exposed more heavily to the hot combustion waste gases, is made, in general, of a metallic material, for example, die-cast aluminum, the preparation of recesses in this material, of which the heat exchanger housing is made, leads to an interruption in the metallic material. Since the material of which the heat exchanger arrangement or the heat exchanger housing thereof is made has, in general, a markedly higher thermal conductivity and therefore a lower thermal resistance than for example, the air present in such a recess, the discharge of heat from the heat exchanger arrangement is reduced by the fact that a greater thermal resistance is thus provided, in general, in the area of the recesses.

In order to avoid a mutual compromise with the fluid flow space, it is proposed that at least one recess be essentially open outwardly in the axial direction on an end face facing away from the bottom walls.

An equally stable design, which can be embodied in a simple manner, can be obtained by providing a plurality of recesses following each other in the circumferential direction about the longitudinal axis, or/and by at least one and preferably each recess to be curved about the longitudinal axis or/and elongated in the circumferential direction.

To make it possible for a fluid to be heated to flow through the fluid flow space or to also guarantee the removal of combustion waste gases generated, for example, in a combustion area of a vehicle heater, it is, further, proposed that a fluid inlet opening to the fluid flow space or/and a fluid outlet opening from the fluid flow space or/and a waste gas outlet opening from a waste gas flow space enclosed by the inner heat exchanger housing be provided in the second axial end area.

To provide sufficient space for such inlet or outlet openings, it is proposed that at least one recess provided in the circumferential area of the fluid inlet opening or/and at least one recess provided in the circumferential area of the fluid outlet opening or/and at least one recess provided in the circumferential area of the waste gas outlet opening have, at least in some areas, a lower depth than a recess provided in a circumferential area that does not essentially intersect the fluid inlet opening or/and the fluid outlet opening or/and the waste gas outlet opening. The consequence of this design is that where there is no mutual compromise with a fluid inlet opening or fluid outlet opening or a waste gas outlet opening, recesses or a recess with a correspondingly greater depth can be provided, which leads to a further increase in the thermal resistance.

A compact embodiment of the heat exchanger arrangement can be obtained by the inner heat exchanger housing having a front wall axially defining the fluid flow space or/and a third circumferential wall that extends over the second circumferential wall on its outer side and is connected to this in the second axial end area.

The front wall may be designed as a wall extending circumferentially in a ring-shaped manner in the circumferential direction. However, to make it possible to guarantee the flow of fluid to the fluid inlet opening or to the fluid outlet opening, it is proposed that the fluid flow space extend in the axial direction beyond the front wall in the area of the fluid inlet opening or/and in the area of the fluid outlet opening. This means that the front wall, which is otherwise designed as a wall extending circumferentially in a ring-shaped manner, may be interrupted in the area of these openings or may have bulges enclosing these openings.

To avoid the deposit of contaminants in the area of the heat exchanger arrangement, it is, further, proposed that at least one recess be closed by a closing element.

The heat-insulating effect introduced by the provision of at least one recess in the material of which a heat exchanger housing is made can be utilized especially efficiently if at least one recess and preferably each recess contains an insulating material with a thermal conductivity lower than that of the material of which the heat exchanger housing having the recess or recesses in question is made.

The insulating material preferably fills the at least one recess essentially completely.

In one embodiment, which can be embodied in an especially simple manner and provides a highly efficient heat insulation, the insulating material may comprise air. It should be pointed out that a combination of different heat-insulating insulating materials may be provided in another embodiment variant. For example, porous or cellular foam-like material, in the inner volume area of which air is contained, may be contained in at least one recess. For example, PU foam or foamed silicone material may be used.

The material of which at least one heat exchanger housing having a recess is made preferably comprises a metallic material, preferably aluminum. Metallic material, i.e., for example, aluminum, advantageously forms the principal component of the material, especially if this material is provided as an alloy.

The present invention will be described in detail below with reference to the attached figures.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
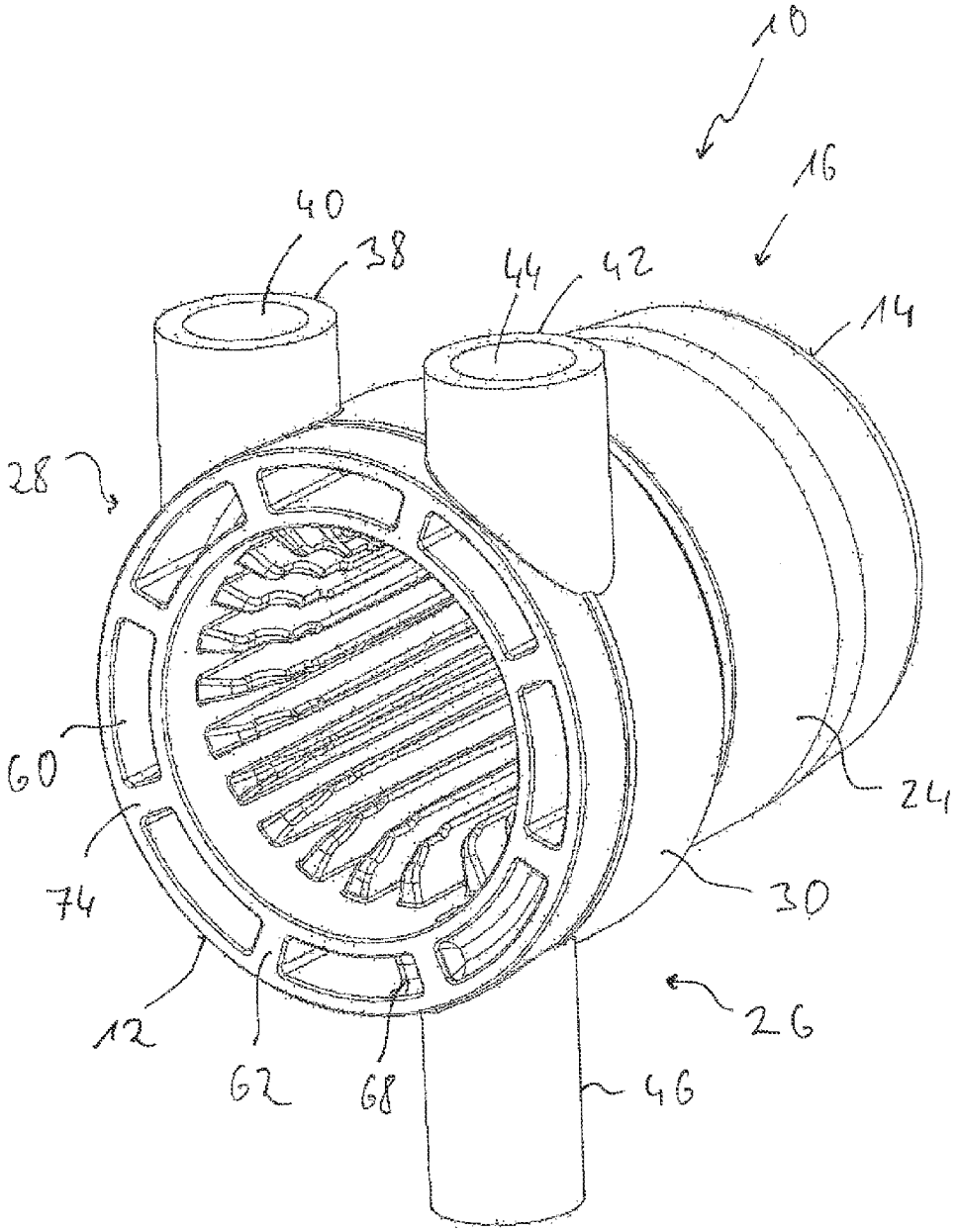
FIG. 1 is a perspective view of a heat exchanger arrangement.

Referring to the drawings, a heat exchanger arrangement, which can be used, for example, in conjunction with a fuel-operated vehicle heater, is generally designated by 10 in the figures. The heat exchanger arrangement 10 comprises two heat exchanger housings 12, 14 inserted into one another. The inner heat exchanger housing 12 comprises in a first axial end area 16 of the heat exchanger arrangement 10 a first bottom wall 18 and, adjoining this radially on the outside and extending in the direction of a longitudinal axis L and enclosing the longitudinal axis L, a first circumferential wall 20. The outer heat exchanger housing 14 also comprises in a first axial end area 16 of the heat exchanger arrangement 10 a second bottom wall 22 as well as, adjoining same radially on the outside, a second circumferential wall 24 extending in the direction of the longitudinal axis L and enclosing same. It should be noted here that the two heat exchanger housings 12, 14 with their bottom walls 18, 22 and their circumferential walls 20, 24 in the exemplary embodiment being shown are each integrally formed components, which are manufactured, for example, as diecast aluminum parts. The circumferential walls or bottom walls could, in principle, also be designed as separately built components connected to one another in one or both of the heat exchanger housings 12, 14.

Figure 2:
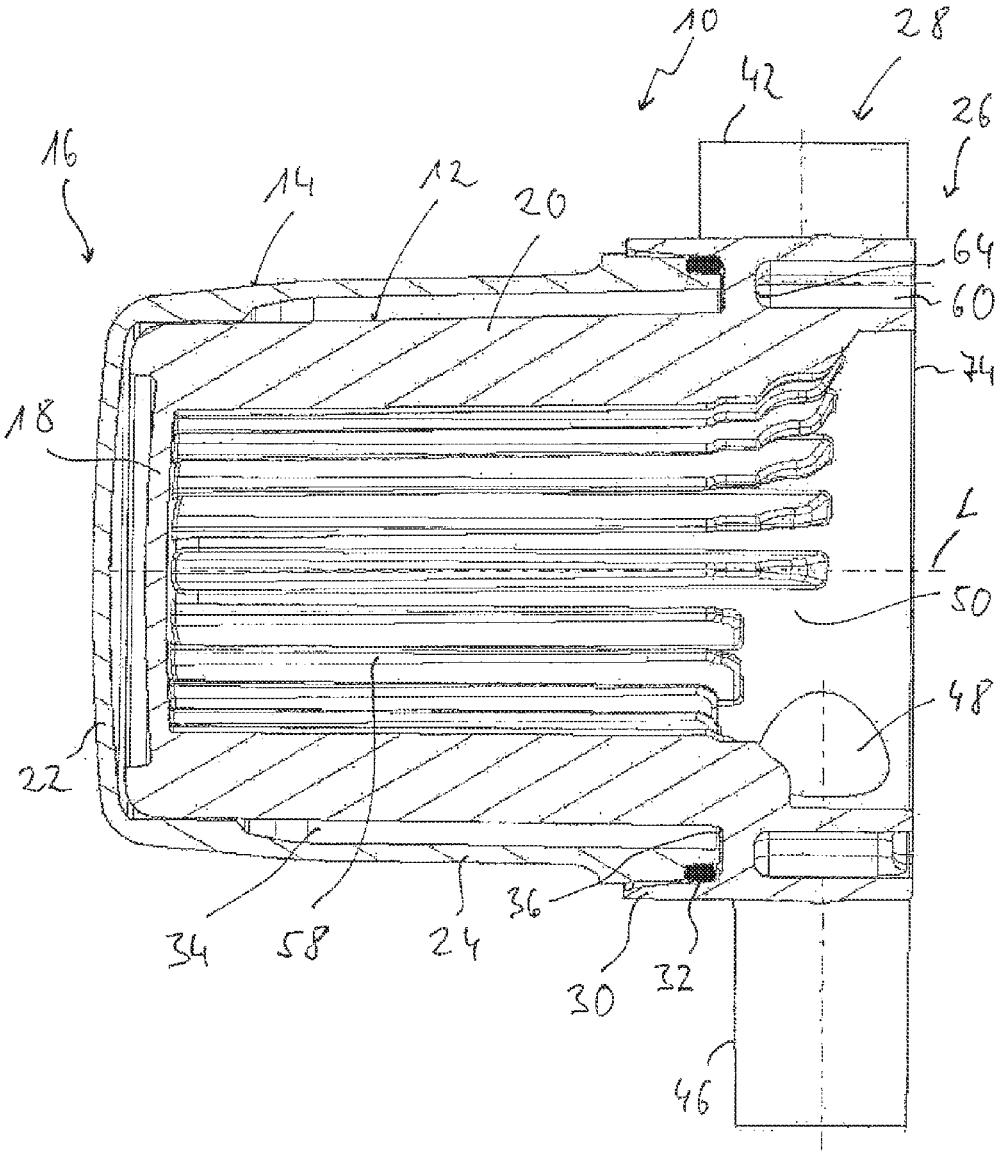
FIG. 2 is a longitudinal sectional view of the heat exchanger arrangement according to FIG. 1, cut along a line II-II in FIG. 3.

In a second axial end area 26 of the heat exchanger arrangement 10 located at a distance from the bottom walls 18, 22, the inner heat exchanger housing 12 forms, with a ring-shaped end section 28, a connection to the outer heat exchanger housing 14. In this ring-shaped end section 28, the inner heat exchanger housing 12 extends radially on the outside beyond the second circumferential wall 20 of said heat exchanger housing and has a third circumferential wall 30 extending in the direction of the first axial end area. This third circumferential wall 30 extends over the second circumferential wall 24 radially on the outside and is rigidly connected to same via the intermediary of an O-ring-like sealing element 32, for example, by pressing, welding, bonding or the like. A fluid flow space generally designated by 34, which is closed or defined in the axial direction at the second axial end area 26 by a front wall 36 extending between the first circumferential wall 20 and the third circumferential wall 30 of the inner heat exchanger housing 12, is formed in this manner between the inner heat exchanger housing 12 and the outer heat exchanger housing 14. This front wall 36 is designed such that it extends circumferentially in a ring-shaped manner about the longitudinal axis L, it is advantageously located essentially in an axial area in relation to the longitudinal axis L, i.e., essentially at right angles thereto, and has a plane design, as this is shown in FIG. 2, but it could also be provided with a conical or truncated cone-like structure.

In a connection area 28 extending axially beyond the outer heat exchanger housing 14, the inner heat exchanger housing 12 has a fluid inlet opening 40 formed in a fluid inlet connecting piece 38 as well as a fluid outlet opening 44 provided in a fluid outlet connecting piece 42. The fluid inlet opening 40 and the fluid outlet opening 44 are open towards the fluid flow space 34. As this is shown in FIG. 2, the connecting pieces 40, 42 are arranged essentially on the axial side facing away from the fluid flow space 34 in relation to the front wall 36. To nevertheless establish a fluid exchange connection, the front wall 36, which otherwise extends circumferentially in a ring-shaped manner, may be interrupted where the fluid inlet opening 40 or the fluid outlet opening 44 is provided, so that a bulge that is in connection with the fluid flow space 34 and is also in connection with the respective opening 40 and 44 is formed in the end section 28.

Figure 4:
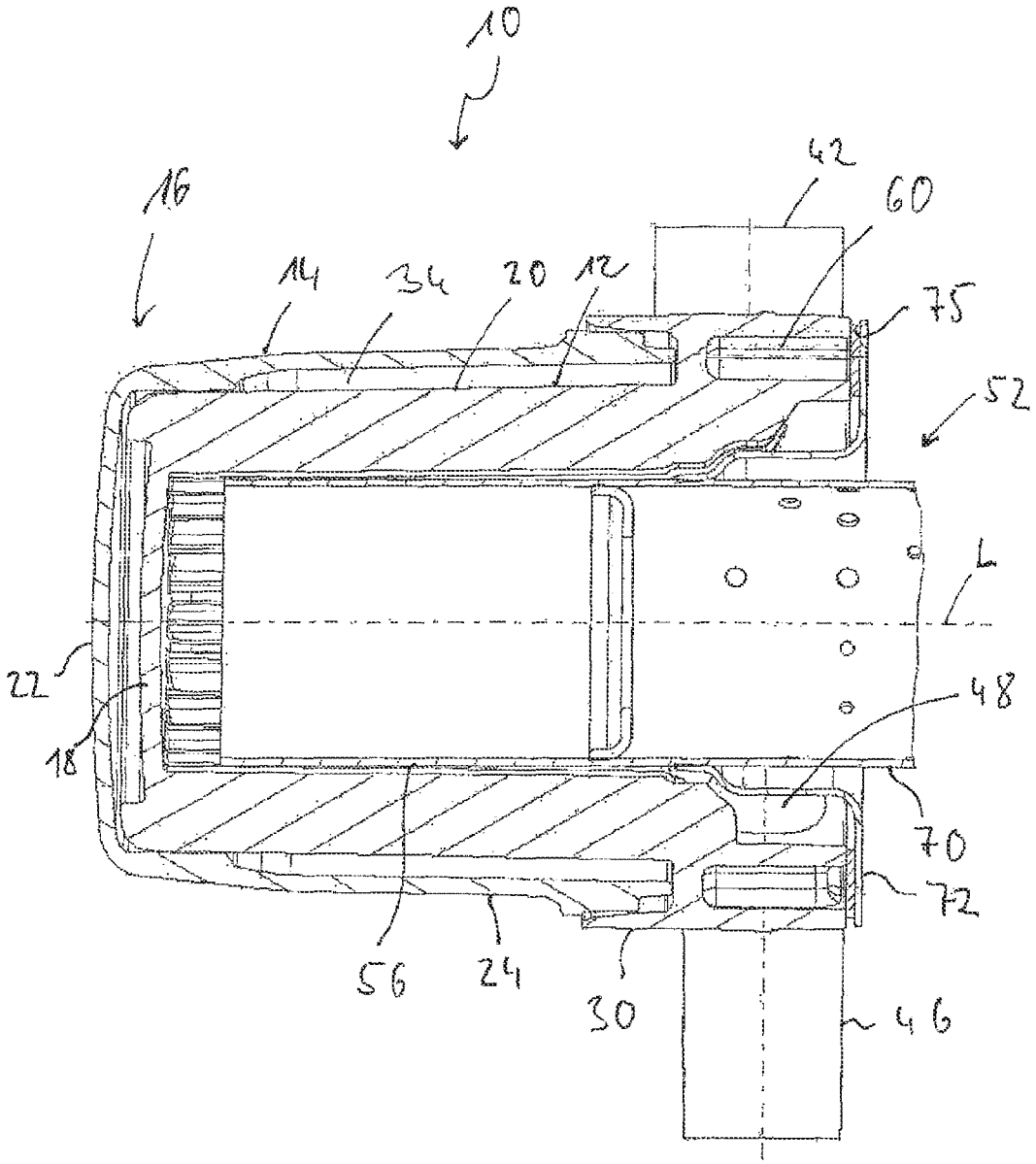
FIG. 4 is a longitudinal sectional view of the heat exchanger arrangement, which sectional view corresponds to FIG. 2, in conjunction with a combustion chamber assembly unit of a vehicle heater.

Further, a waste gas outlet opening 48 is provided in a waste gas outlet connecting piece 46 in the second axial end area 26 of the heat exchanger arrangement 10. This outlet opening is open towards the inner side of the first circumferential wall 20 and hence towards a waste gas flow space 50 enclosed by the inner heat exchanger housing 12. As this is shown in FIG. 4, the combustion waste gases generated in a combustion chamber assembly unit 52 or in a combustion 54 thereof are sent through a flame tube 56 positioned such that it extends into the inner heat exchanger housing 12 in the direction of the first bottom wall 18. After reaching the first bottom wall 18, the combustion waste gases are deflected radially to the outside and then flow back in the waste gas flow space 50 from the first axial end area 16 to the second axial end area 26 and the waste gas outlet opening 48 provided there. The combustion waste gases now flow along heat transfer ribs 58, which are provided on an inner side of the inner heat exchanger housing 12 to enlarge the heat transfer surface.

Figure 3:
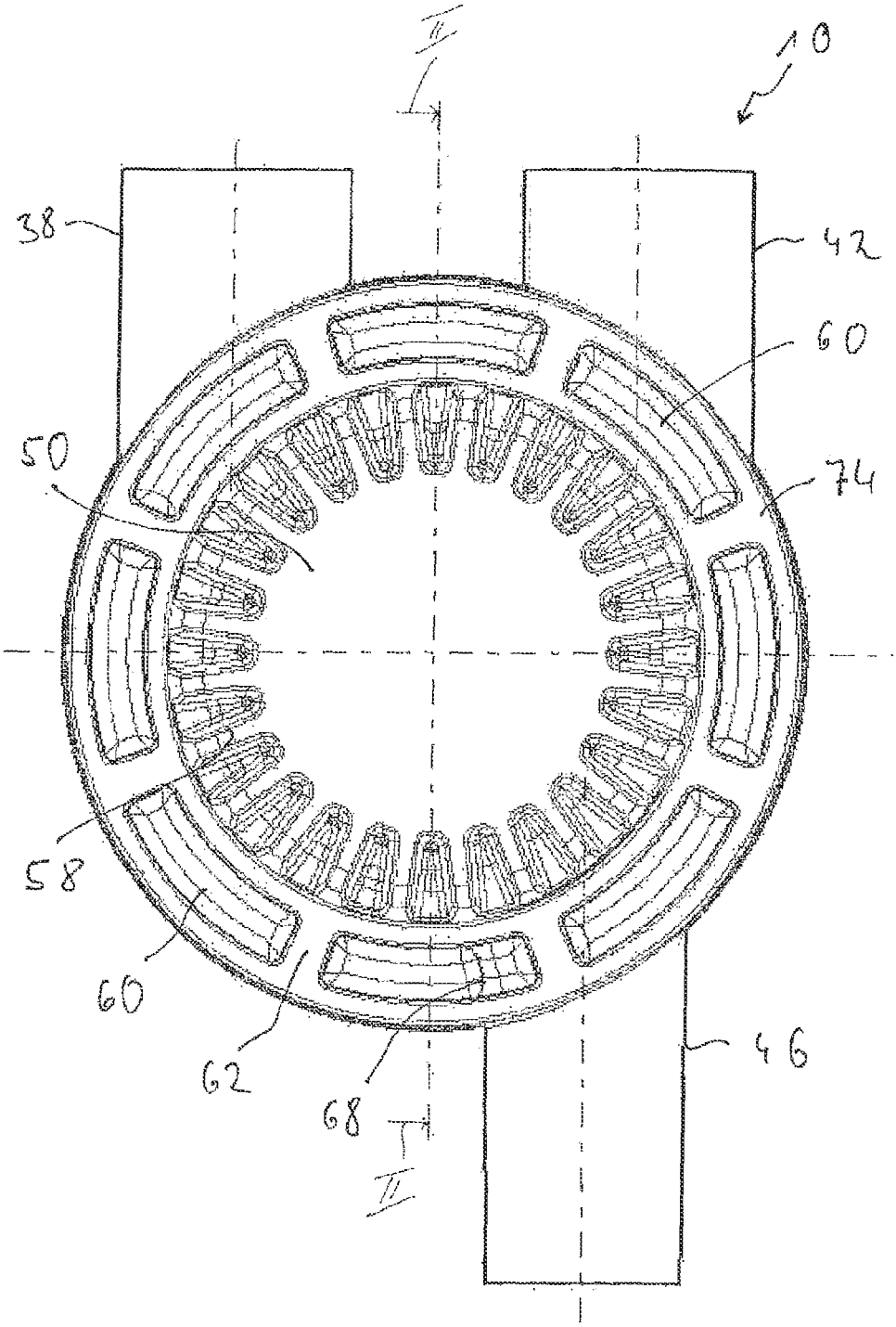
FIG. 3 is an axial view of the heat exchanger arrangement according to FIG. 1.

A plurality of recesses 60, which are prepared, for example, during the casting operation in which the inner heat exchanger housing 12 is manufactured or/and recesses 60 prepared by machining are provided in the material of which the inner heat exchanger housing 12 is made in the exemplary embodiment being shown in the second axial end area 26 of the heat exchanger arrangement 10 in the inner heat exchanger housing 12, especially in the end section 28 thereof axially adjoining the fluid flow space 34. The recesses 60 are arranged such that they follow each other in the circumferential direction about the longitudinal axis L and have, for example, each equal circumferential extensions or/and radial extensions. The recesses 60, adapted to the ring-shaped form of the heat exchanger housing, are preferably curved or/and elongated in the circumferential direction. Walls 62 separating the individual recesses 60 are located between the individual recesses 60. The axial depth of the recesses 60 is selected to be such that, as this is clearly shown in FIG. 2, a wall area 66 separating the recesses 60 from the fluid flow space 34 is formed between the front wall 36 and a respective bottom area 64 of the recesses 60. As can be seen in area 68 in FIGS. 1 and 3, the recesses 60 may be made with a lower recess depth where there is a circumferential intersection of recesses 60 with the fluid inlet opening 40, the fluid outlet opening 44 or the waste gas outlet opening 48 or the connecting pieces 38, 42, 46 providing these openings. In the circumferential areas not overlapping with these openings or connecting pieces, the recesses 60 preferably have each equal depths that maximally utilize the existing axial installation space in the end section 28. By providing the recesses 60, which are open towards the outside, in the axial direction in the example being shown, cavities are created in the material of which the heat exchanger arrangement, especially the inner heat exchanger housing 12 exposed comparatively intensely to heat due to the hot combustion waste gases, is made. The dissipation of heat towards the outside to the surrounding area is reduced by these cavities or interruptions in the material of which the heat exchanger arrangement or the inner heat exchanger housing 12 is made, because there is a higher thermal resistance in the area of the recesses 60 than in the area in which the material of which the inert heat exchanger housing 12 is made, for example, in the area of the wall 66. Heat losses can thus be reduced especially in the second axial end area 26.

As this is shown in FIG. 4, a support 72, which establishes a connection between the combustion chamber assembly unit 52 and the heat exchanger arrangement 10 and is connected, for example, to the flame tube 56 or to a combustion chamber wall 70, may cover the recesses 60 or at least a part thereof on the end face 74 on which the recesses 60 are axially open in the material of which the inner heat exchanger housing 12 is made. For example, a flexible sealing element 75 of a ring-shaped design may be interposed here. The rigid connection of the support 72 to the inner heat exchanger housing 12 may be brought about, for example, by bolts, which pass through the support 72 in the area thereof that extends radially to the outside and also extends over the recesses 60 and are inserted into the connection area 28 of the inner heat exchanger housing 12.

To make it possible to utilize the insulation effect introduced by the provision of the recesses 60 efficiently, some and preferably all recesses 60 are filled with a heat-insulating material. Heat-insulating means here that the material with which the recesses 60 are filled has a lower thermal conductivity than the material of which the heat exchanger housing having these recesses 60 is made. For example, these recesses 60 may be filled essentially completely with air, which has a lower thermal conductivity than, for example, the aluminum material used to make such a heat exchanger housing by several orders of magnitude. It should be noted in this connection that the thermal conductivity may be considered for the purposes of the present invention in the temperature range relevant for the operation of a heat exchanger arrangement having such a design, for example, in the range of −50° C. to +250° C. in the area in which the recesses 60 are provided in the heat exchanger housing.

At least part of the heat-insulating material in at least one recess may be provided as a solid material. This may be provided, for example, as a porous or cellular material, for example, as a foam material, e.g., PU foam or silicone foam, which contains air in its inner volume area. It is also possible that the sealing element 75 providing a closing element covering the recesses 60 or at least some of the recesses 60 is formed with material sections meshing with at least one of the recesses 60 and preferably with each recess 60 covered by it to provide the insulating material.

It is obvious that as an alternative or in addition to the recesses in the material of which a heat exchanger housing is made, which recesses are shown in the figures, it is also possible to provide recesses on other areas or recesses that are open in another direction, for example, radially outwardly, and advantageously also recesses that are closed by a closing element.

While specific embodiments of the invention have been shown and described in detail to illustrate the application of the principles of the invention, it will be understood that the invention may be embodied otherwise without departing from such principles.

What is claimed is:

1. A heat exchanger arrangement for a vehicle heater, the heat exchanger arrangement comprising:

a pot-shaped inner heat exchanger housing comprising a first bottom wall in a first axial end area of the heat exchanger arrangement and a first circumferential wall adjoining the first bottom wall and enclosing a longitudinal axis of the heat exchanger arrangement;

a pot-shaped outer heat exchanger housing comprising a second bottom wall in the first axial end area of the heat exchanger arrangement and a second circumferential wall adjoining the second bottom wall and enclosing the longitudinal axis, wherein the inner heat exchanger housing is inserted into the outer heat exchanger housing and is connected to the outer heat exchanger housing in a second axial end area of the heat exchanger arrangement;

a fluid flow space defined between the inner heat exchanger housing and the outer heat exchanger housing;

at least one recess in the second axial end area of the heat exchanger arrangement that is open to an outside of the heat exchanger arrangement, the recess being formed outwardly open in at least one of the material of the inner heat exchanger housing and in the material of the outer heat exchanger housing, wherein in the second axial end area, the inner heat exchanger housing has a front wall that axially defines the fluid flow space, wherein the front wall comprises a wall extending circumferentially in a ring-shaped manner in the circumferential direction; and a fluid inlet opening to the fluid flow space and a fluid outlet opening from the fluid flow space provided in the second axial end area of the inner heat exchanger housing, wherein the fluid flow space extends beyond the front wall in the axial direction at least one of in the area of the fluid inlet opening and in the area of the fluid outlet opening.

2. A heat exchanger arrangement in accordance with claim 1, wherein the at least one recess opens essentially in an axial direction on a front side facing away from the bottom walls.

3. A heat exchanger arrangement in accordance with claim 1, further comprising at least another outwardly open recess to provide a plurality of recesses, wherein:

the recesses follow another recess in a circumferential direction about the longitudinal axis and at least one of the recesses is curved about the longitudinal axis or is elongated in the circumferential direction.

4. A heat exchanger arrangement in accordance with claim 1, further comprising a waste gas outlet opening from a waste gas flow space enclosed by the inner heat exchanger housing is provided in the second axial end area.

5. A heat exchanger arrangement in accordance with claim 4, wherein the at least one recess opens essentially in an axial direction on a front side facing away from the bottom walls and the heat exchanger arrangement further comprising another outwardly open recess to provide a plurality of recesses, wherein at least one of the recesses is provided in the circumferential area of the at least one of the fluid inlet opening and the fluid outlet opening and the waste gas outlet opening and has, in at least some areas, a lower depth than other of the recesses provided in a circumferential area that do not essentially intersect of the at least one of the fluid inlet opening and the fluid outlet opening and the waste gas outlet opening.

6. A heat exchanger arrangement in accordance with claim 1, wherein in the second axial end area, the inner heat exchanger housing has a third circumferential wall extending from the second circumferential wall on an outer side thereof and connected to same.

7. A heat exchanger arrangement in accordance with claim 1, wherein the at least one recess is closed by a closing element.

8. A heat exchanger arrangement in accordance with claim 1, further comprising at least another outwardly open recess to provide a plurality of recesses wherein at least one of the recesses contains insulating material with a thermal conductivity lower than that of the at least one of the material of the inner heat exchanger housing and in the material of the outer heat exchanger housing in which said recess is formed.

9. A heat exchanger arrangement in accordance with claim 8, wherein the insulating material fills the at least one recess essentially completely.

10. A heat exchanger arrangement in accordance with claim 8, wherein the insulating material comprises air or/and foamed material.

11. A heat exchanger arrangement in accordance with claim 1, wherein at least one of the material of the inner heat exchanger housing and in the material of the outer heat exchanger housing in which said recess is formed comprises a metallic material.

12. A heat exchanger arrangement in accordance with claim 1, wherein at least one of the material of the inner heat exchanger housing and in the material of the outer heat exchanger housing in which said recess is formed comprises aluminum.

13. A heat exchanger arrangement in accordance with claim 1, wherein the at least one recess is closed at one end.

14. A heat exchanger arrangement comprising:

an inner heat exchanger housing comprising a first axial end area inner bottom wall, an inner circumferential wall adjoining the first axial end area inner bottom wall and extending from the first axial end area inner bottom wall to enclose a longitudinal axis of the heat exchanger arrangement;

an outer heat exchanger housing comprising a first axial end area outer bottom wall and an outer circumferential wall adjoining the first axial end area outer bottom wall and extending from the first axial end area outer bottom wall to enclose the longitudinal axis, wherein the inner heat exchanger housing is inserted into the outer heat exchanger housing and the inner heat exchanger housing is connected to the outer heat exchanger housing in a second axial end area of the heat exchanger arrangement spaced away from the first axial end area and wherein at least the first axial end area inner bottom wall and the first axial end area outer bottom wall or the inner circumferential wall and the outer circumferential wall are spaced apart to define a fluid flow space between the inner heat exchanger housing and the outer heat exchanger housing, wherein at least one of the material of the inner heat exchanger housing and the material of the outer heat exchanger housing define an outwardly open recess in the second axial end area of the heat exchanger arrangement that is open to an outside of the heat exchanger arrangement, wherein the inner heat exchanger housing has a front wall in the second axial end area, the front wall axially defining the fluid flow space, wherein the front wall comprises a wall extending circumferentially in a ring-shaped manner in the circumferential direction; and a fluid inlet opening to the fluid flow space; and a fluid outlet opening from the fluid flow space provided in the second axial end area of the inner heat exchanger housing, wherein the fluid flow space extends beyond the front wall in the axial direction at least one of in the area of the fluid inlet opening and in the area of the fluid outlet opening.

15. A heat exchanger arrangement in accordance with claim 14, further comprising:

a waste gas outlet opening from a waste gas flow space enclosed by the inner heat exchanger housing.

16. A heat exchanger arrangement in accordance with claim 15, further comprising at least another outwardly open recess to provide a plurality of recesses, wherein:

the recesses follow another recess in a circumferential direction about the longitudinal axis and at least one of the recesses is curved about the longitudinal axis or is elongated in the circumferential direction.

17. A heat exchanger arrangement in accordance with claim 16, wherein at least one of the recesses is provided in the circumferential area of at least one of the fluid inlet opening and the fluid outlet opening and the waste gas outlet opening and has, in at least some areas, a lower depth than other of the recesses provided in a circumferential area that do not essentially intersect at least one of the fluid inlet opening and the fluid outlet opening and the waste gas outlet opening.

18. A heat exchanger arrangement in accordance with claim 16, wherein in the second axial end area, the inner heat exchanger housing has a third circumferential wall extending from the second circumferential wall on an outer side thereof and connected to same.

19. A heat exchanger arrangement in accordance with claim 14, wherein the open recess is closed at one end.

20. A heat exchanger arrangement comprising:

an inner heat exchanger housing comprising a first axial end area inner bottom wall, an inner circumferential wall adjoining the first axial end area inner bottom wall and extending from the first axial end area inner bottom wall to enclose a longitudinal axis of the heat exchanger arrangement;

an outer heat exchanger housing comprising a first axial end area outer bottom wall and an outer circumferential wall adjoining the first axial end area outer bottom wall and extending from the first axial end area outer bottom wall to enclose the longitudinal axis, wherein the inner heat exchanger housing is inserted into the outer heat exchanger housing and the inner heat exchanger housing is connected to the outer heat exchanger housing in a second axial end area of the heat exchanger arrangement spaced away from the first axial end area and wherein at least the first axial end area inner bottom wall and the first axial end area outer bottom wall or the inner circumferential wall and the outer circumferential wall are spaced apart to define a fluid flow space between the inner heat exchanger housing and the outer heat exchanger housing, wherein at least one of the material of the inner heat exchanger housing and the material of the outer heat exchanger housing define an outwardly open recess in the second axial end area of the heat exchanger arrangement that is open to an outside of the heat exchanger arrangement, at least one of the inner heat exchanger housing and the outer heat exchanger housing comprising a first housing portion, a second housing portion and a third housing portion, the first housing portion and the second housing portion extending in the circumferential direction, the first housing portion being located at a radially spaced location from the second housing portion with respect to the longitudinal axis, the third housing portion extending in a radial direction with respect to the longitudinal axis, the third housing portion being connected to the first housing portion and the second housing portion, at least the first housing portion, the second housing portion and third housing portion defining a plurality of recesses, one of the recesses being located directly adjacent to another one of the recesses in the circumferential direction, wherein the one of the recesses is separated from the another one of the recessed in the circumferential direction via the third housing portion, wherein the inner heat exchanger housing has a front wall in the second axial end area, the front wall axially defining the fluid flow space, wherein the front wall comprises a wall extending circumferentially in a ring-shaped manner in the circumferential direction; and a fluid inlet opening to the fluid flow space; and a fluid outlet opening from the fluid flow space provided in the second axial end area of the inner heat exchanger housing, wherein the fluid flow space extends beyond the front wall in the axial direction at least one of in the area of the fluid inlet opening and in the area of the fluid outlet opening.

* * * * *